US007410037B2

(12) United States Patent
De La Fuente-Farias

(10) Patent No.: US 7,410,037 B2
(45) Date of Patent: Aug. 12, 2008

(54) SPARE BRAKE BEAM

(75) Inventor: Jorge Alberto De La Fuente-Farias, Nuevo Leon (MX)

(73) Assignee: A. Stucki Company, a Delaware Corporation, Pittsburgh, PA (US)

( * ) Notice: Subject to any disclaimer, the term of this patent is extended or adjusted under 35 U.S.C. 154(b) by 244 days.

(21) Appl. No.: 11/098,523

(22) Filed: Apr. 5, 2005

(65) Prior Publication Data

US 2006/0219501 A1 Oct. 5, 2006

(51) Int. Cl.
*B61H 13/36* (2006.01)

(52) U.S. Cl. ..... 188/233.3; 188/219.1; 188/228.6

(58) Field of Classification Search ..... 188/219.1, 188/225.6, 228.6, 233.3
See application file for complete search history.

(56) References Cited

U.S. PATENT DOCUMENTS

| | | | | |
|---|---|---|---|---|
| 2,597,287 | A * | 5/1952 | Busse | 188/228.6 |
| 5,947,236 | A * | 9/1999 | Sauter | 188/228.1 |
| 6,551,003 | B1 * | 4/2003 | De La Fuente-Farias | 403/65 |

* cited by examiner

*Primary Examiner*—Bradley T King
(74) *Attorney, Agent, or Firm*—Young & Thompson

(57) ABSTRACT

A spare brake beam for railway cars which can be quickly and easily installed in a train car without the necessity of cutting the car from the train nor dismantling the car nor the truck.

4 Claims, 5 Drawing Sheets

SPARE BRAKE BEAM

BACKGROUND OF THE INVENTION

A. Field of the Invention

The present invention is related to brake beams for railway cars, and more particularly to a spare brake beam which allows a quick installation thereof.

B. Description of the Related Art

There are well known brake heads assemblies for railway cars by which a brake shoe is pressed against a wheel in order to decrease or stop the rotational speed of the wheel and railway car.

Generally, the brake head assembly is held by a structure called "brake beam" mounted transversely in the bogie of a railway car and is linked to a lever, which applies a force in order to press the brake shoe against a wheel.

The brake beam generally comprises, a generally "V" shaped tension member a compression member having its ends coupled to the ends of the tension member, a brake head subassembly linked to the each end of the compression member, two end extensions each coupled to an end of the compression member by which the brake beam is coupled to the bogie of a railway car and a fulcrum coupled to the compression member and tension member, so that the fulcrum remains between the tension and compression members. The end extensions of the brake beam are coupled to both pocket guides of the trucks The main reasons for replacing a Brake Beam out of a freight car are the following:

A worn out condition.

A broken brake beam

A bent brake beam

A missing brake beam

When it is necessary to install a new brake beam, the damaged car must be decupled from the train, and taken to a repairing facility which could be many miles away.

Once in the facility, the car must be jacked up, then the truck must be disconnected and retired from under the car, proceeding to the dismantling of side frames and corresponding wheel set, in order to decuple the brake beam end extensions from the pocket guides and then remove the damaged brake beam, for reapplication of the new brake beam, proceeding then to reinsert wheel set and side frames, push truck under the car, reconnect and lower the car body on top.

The above referred operation is a main cause for car repair personnel injuries, it's very complex, it's costly and time consuming since it may take from 3 to 7 days to replace a brake beam. And worst, the owner of the car and the transport company, looses money for each minute the car is inactive, besides angry customers since usually the car that is cut from the train is completely loaded, facing penalties or damaged perishable goods.

In order to reduce the time and effort necessary to replace a brake beam, applicant developed a spare brake beam which can be quickly and easily installed in a train car without the necessity of cutting the car from the train nor dismantling the car nor the truck.

Applicant's spare brake beam includes: an interlocking member each coupled at an end of the brake beam compression and tension members inside its hollow cross section and having a brake beam coupling section directly coupled to the brake beam main body and an end extension coupling section; a removable end extension having a pocket guide coupling section and a brake beam coupling section linked to the end extension coupling section of a linking member, linked to the brake beam main body.

Thanks to applicant's spare brake beam it is not necessary to dismantle the car for replacing the brake beam and therefore the operation can be carried out without cutting the car from the train thus saving money on labor and materials.

Furthermore, the brake beam replacement operation can be completed in matter of minutes, saving time on all type of freight cars using a standard Brake beam, being particularly beneficial on intermodal or premium service trains and avoiding penalties and costs related with previous mounting systems.

Thanks to the spare brake beam of the present invention, it is possible to replace any kind of brake beam which is found at a damaged condemnable condition under a car in service, by a simple torch cut off process of the damaged beam under the car, pulling then the damaged component from the car bottom, which activity is simple and familiar to must skilled in the car repair art, and be then able to install the spare brake beam of the present invention, as an spare brake beam, right there and then, without the dismantling of the train, car nor truck, with simple common tools and skills.

Finally, since it is no longer necessary to dismantle the car for changing a brake beam, there are avoided the related and common accidents and personal injuries to the maintenance staff.

SUMMARY OF THE INVENTION

It is therefore a main object of the present invention to provide a spare brake beam which can be quickly and easily installed in the boogie of a train car.

It is another main object of the present invention to provide a spare brake beam by which can be installed without dismantling the car and therefore the operation can be carried out without cutting the car from the train thus saving money on labor and materials It is still a main object of the present invention to provide a spare brake beam which can be installed in matter of minutes saving time on all type of freight cars using a standard brake beam, being particularly beneficial on intermodal or premium service trains, and avoiding penalties and costs related with previous mounting systems.

It is still another main object of the present invention to provide a spare brake beam thanks to which there are avoided the accidents and personal injuries to the maintenance staff related to car dismantling operations.

These and other objects and advantages of the spare brake beam of the present invention will become apparent to those persons having an ordinary skill in the art, from the following detailed description of the embodiments of the invention which will be made with reference to the accompanying drawings.

DETAILED DESCRIPTION OF THE INVENTION

Figure 1:
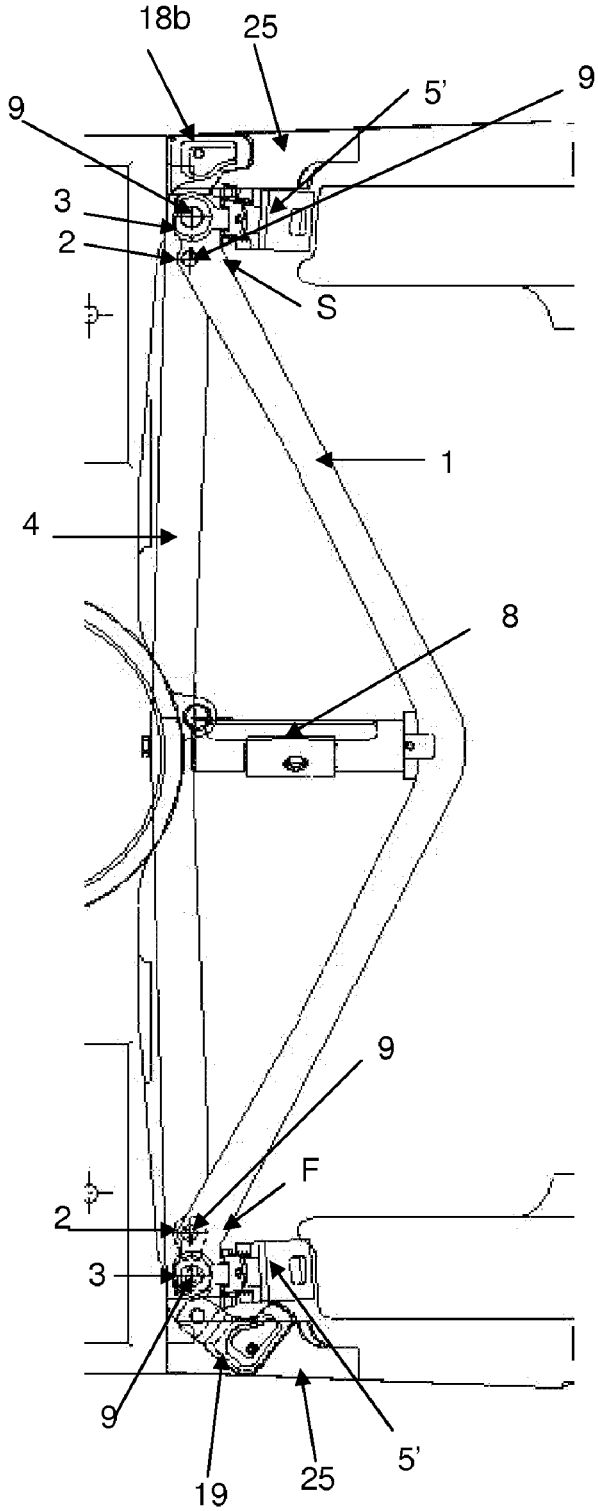
FIG. 1 is an upper view of a boogie of a railway car having the spare brake beam of the present invention having the removable end extension detached from the interlocking member.

The spare brake beam of the present invention will now be described making reference to a common brake beam, in accordance with its most general embodiment thereof illustrated in the accompanying drawings wherein the same signs and numbers, refer to the same parts of the shown figures, comprising:

a "V" shaped tension member 1 having a first end "F" and a second "S" end, said "V" shaped tension member having a channel shaped cross section (not shown) including a lower wall and two upwardly projecting side walls, each depending from an edge of the lower wall, and including a first pair of opposite holes 2 each located in a side wall near the ends of the tension member and a second pair of opposite holes 3 each located in a side wall at the ends of the tension member;

a compression member 4, having a first end and a second end (not shown) coinciding with the first end "F" and second end "S" of the tension member 1, a channel shaped cross section (not shown) including an upper wall and two depending side walls, each depending from an edge of the upper wall, a channel shaped housing (not shown), and including a first pair of opposite holes (not shown) each located in a side wall near the ends of the tension member and a second pair of opposite holes (not shown) each located in a side wall at the ends of the tension member each pair coinciding with both pair of holes 2, 3 of the tension member, wherein the channel shaped cross section of the each end of the compression member 4 is located and joined inside the channel shaped cross section of the tension member 1;

two brake head subassemblies 5, 5', each having a brake shoe (not shown) and respectively linked to each end of the tension and compression members 1, 4, each having a coupling section 6, having a bore 7 in a central portion thereof coinciding with the second pair of holes of the tension 2, 3 and compression member; and a fulcrum 8 joined to the tension member 1 and compression member 4, so that the fulcrum 8 remains between the tension 1 and compression 4 members.

wherein the tension member 1, compression member 4 and brake head subassemblies 5, 5', are linked together by means of four bolt nut assemblies 9 each passing respectively trough the first and second pair of holes located at each end of the tension member 1 and compression member 4 and trough the bore 7, 7' of each brake head subassembly 5, 5', thus linking the tension member 1, compression member 4 and brake head subassemblies 5, 5' together by a first 10, 10' and a second 11, 11' pair of linking points;

Now, the spare brake beam of the present invention will be described making reference to the above described common brake beam, wherein the spare brake beam of the present invention comprises:

an interlocking member 12 located at the first end of the compression member 4 inside its channel shaped cross section which in turn is located inside the channel shaped cross section of the tension member 1, comprising a solid planar metal piece 13 having a brake beam coupling section 14 having a bore 15 at a central portion thereof coinciding with the first coinciding pair of bores (of the first two pairs of linking points 10, 10') of the tension 1 and compression 4 member and an end extension coupling section 16, opposite to the brake beam coupling section 14 including a coupling edge 17 having an irregular shape and having a bore 18 in a central portion thereof coinciding with the second coinciding pair of bores (of the second pair of linking points 11, 11') of the tension 1 and compression 4 member and with the bore 7, 7' of the coupling section 6, 6' of a brake head subassembly 5, 5' and having a lesser width than the brake beam coupling section 14;

a fixed end extension 18*b* coupled to the second end of the tension member 1;

a removable end extension 19 comprising a solid metal piece having an interlocking member coupling member 20 comprising a clasp formed by two quadrangular planar metallic pieces 21, 21', each including a bore 22, 22' in a central portion thereof, an interlocking member coupling edge receiving section 23 located between both quadrangular planar metallic pieces 21, 21' having the same but opposed shape as the interlocking member 12 coupling edge 17 and a pocket guide coupling member 24 opposed to the interlocking member coupling member 20;

wherein the brake beam coupling section 14 of the interlocking member 12 is coupled to the first end of the tension 1 and compression 4 members by means of the bolt passing trough the first pair of coinciding bores (of the first pair of linking points 10, 10') of the tension 1 and compression 4 member which also passes trough the bore located at a central portion of the interlocking member 12 brake beam coupling section 14 section thus joining the brake beam coupling section 14; and wherein the removable end extension coupling section 16 of the interlocking member 12 is coupled to the tension 1 and compression 4 members and brake head subassembly 5,5' and is received between both quadrangular planar metallic pieces 21, 21' of the removable end extension 19, in such way that its coupling edge 17 engages with the interlocking member coupling edge receiving section 23 and is retained therein by means of the bolt passing through the second pair of coinciding bores (of the second pair of linking points 11, 11') of tension member 1, compression member 4 and brake head subassembly 5, 5' which also passes through the bore 15 located at a central portion of the end extension coupling section 16 of the interlocking member 12 and through the bores 22, 22' located at a central portion of both quadrangular planar metallic pieces 21, 21' forming the clasp which comprise the interlocking member coupling member 20 of the removable end extension 19 thus joining the tension member 1, compression member 4, brake head subassembly 5, 5', interlocking member 12 and removable end extension 19 together.

Since the coupling edge 17 of the interlocking member 12 engages with the interlocking member coupling edge receiving section 23 of the removable end extension 19, it is avoided any lateral movement of the removable end extension 19 with respect to the brake beam when the brakes are applied.

Figure 2:
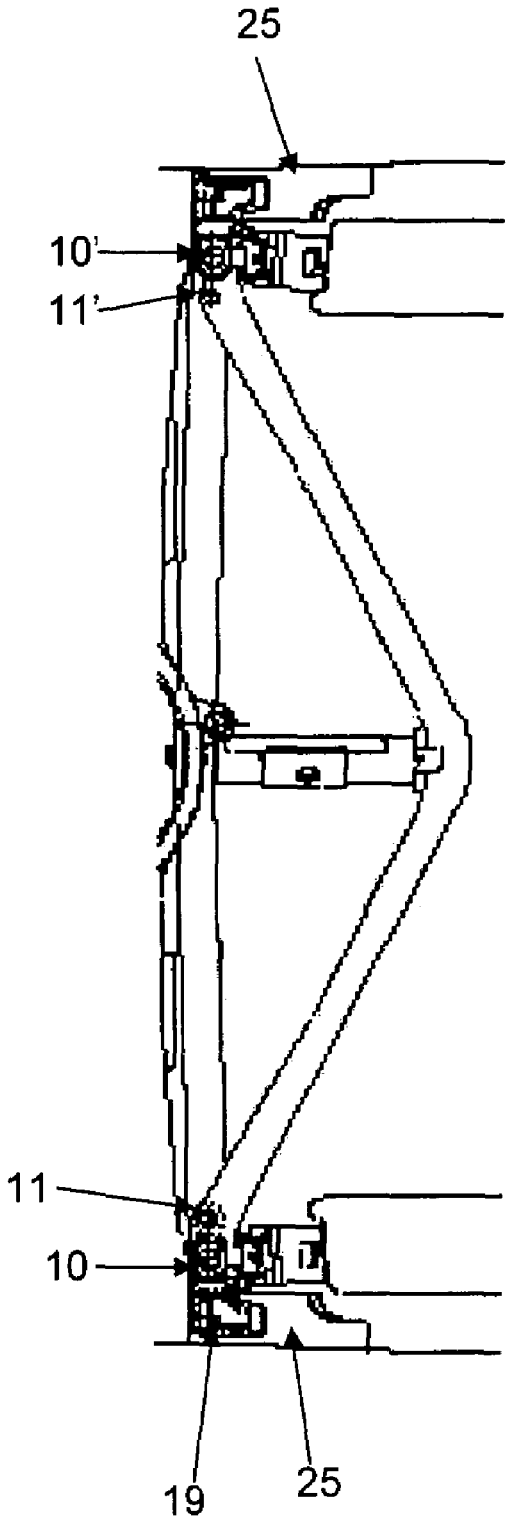
FIG. 2 is an upper view of a boogie of a railway car having the spare brake beam of the present invention having the removable end extension in place.
Figure 3:
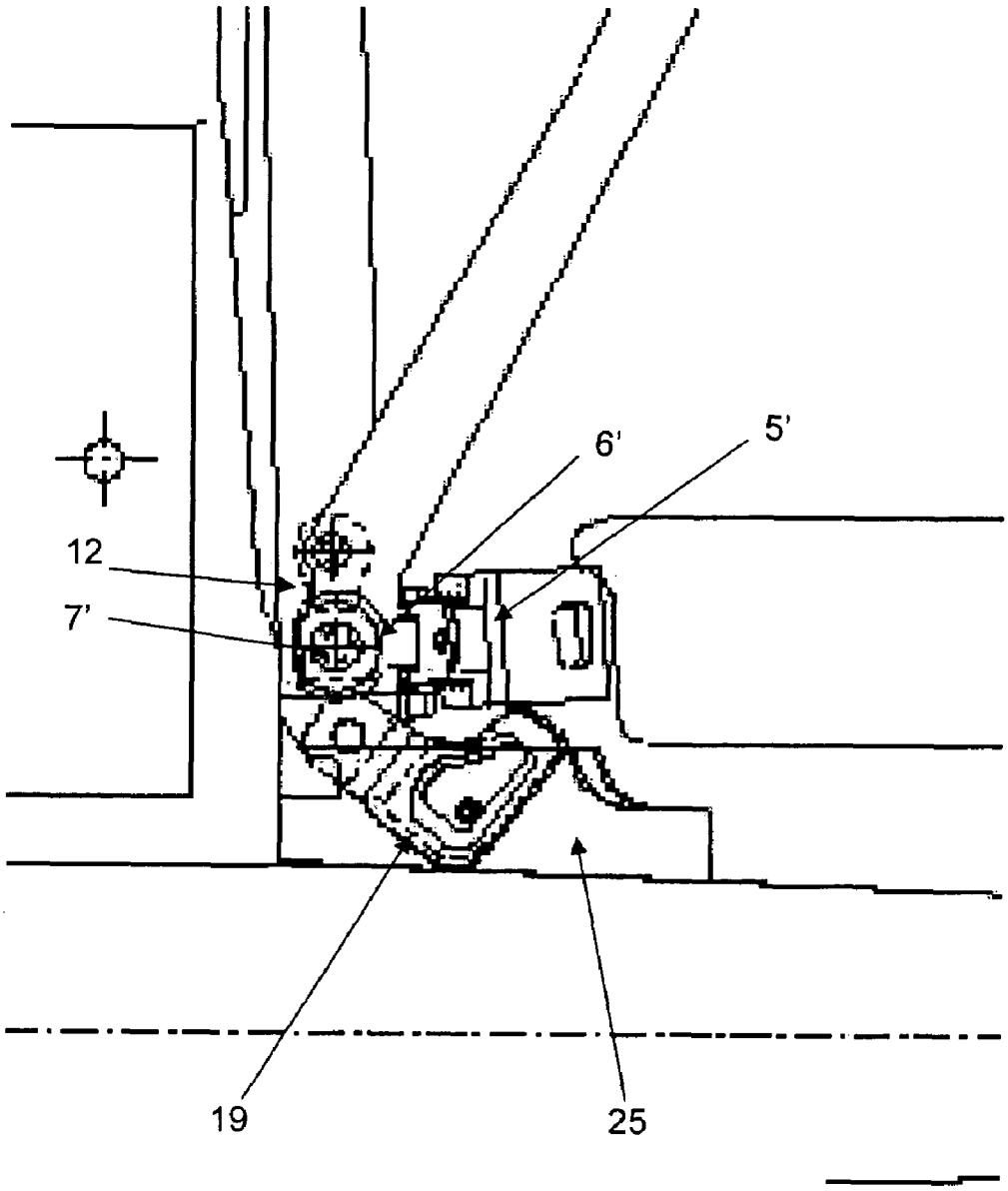
FIG. 3 is an upper view of a section of a boogie of a railway car having the spare brake beam of the present invention having the removable end extension detached from the interlocking member.
Figure 4:
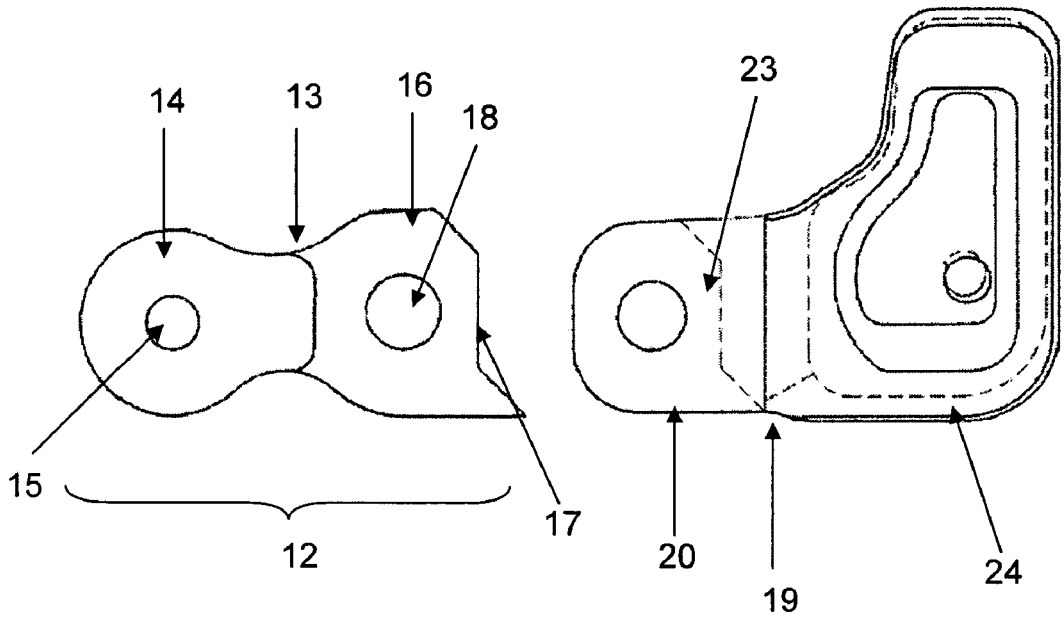
FIG. 4 is an upper view of the interlocking member and removable end extension of the spare brake beam of the present invention.
Figure 5:
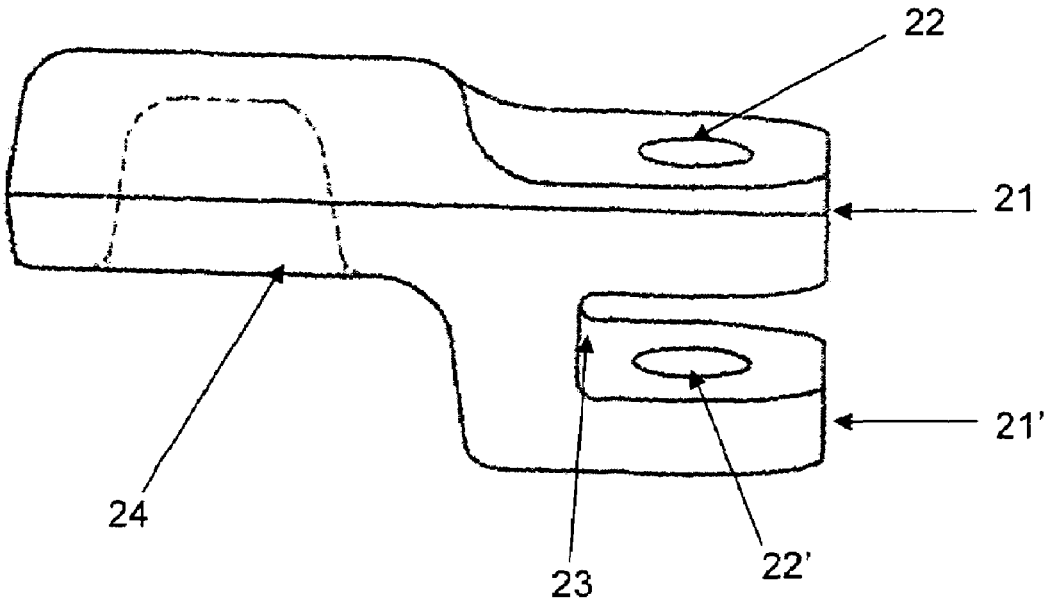
FIG. 5 is a perspective view of the removable end extension of the spare brake beam of the present invention.

When it's necessary to replace a common brake beam from a train car, the condemnable beam must be torched off from the car, decoupled from its linking levers & removed from the boogie (truck). Then, the removable end extension of the spare beam is decoupled from the interlocking member 12, and the pocket guide coupling member 24 is inserted in the boogie pocket guide 25. The corresponding side brake head subassembly 5, 5' is then loose, and may be slided off the beam, to reduce its weight. Next, the spare beam is slided under the boogie sitting on the rail and the end that has the fixed end extension 18, must be lifted, and it's end extension inserted on the opposite side pocket guide 25 of the truck. The first end with the decoupled end extension 19 is then lifted to embrace with it's hollow portion the mating link of the decoupled end extension 19, thus embracing it. This will hold the weight of the beam in place. Next, the spare brake beam is push toward the wheel while at the same time the uncoupled end extension 19 must be slid along its correspondent pocket guide 25, and at the same time the end extension must be slightly rotated over a vertical axis until its interlocking member coupling member 20 is completely inside the brake beam's channel shaped cross section as shown in FIG. 2. Then the corresponding loose brake head is slided back on the spare beam, and all holes aligned, in order for the same provided bolt to be inserted from the top, thus putting together the brake head subassembly, the spare brake beam structure and the decoupled end extension, thorough one single operation.

Thanks to the bolt nut assembly passing trough the first pairs of linking points 10, 10' of the first end of the tension and compression member, it is avoided that the spare brake beam become disassembled when the bolt passing trough the second pair of linking points 11, 11' is retired for decoupling the removable end extension 19.

Although it was described that the spare brake beam of the present invention has one removable end extension 19 and one fixed end extension 18, both end extensions may be removable.

In other embodiments of the invention, the interlocking member 12 may be omitted and instead it could be provided any means for avoiding the lateral movement of the end extensions—interlocking means—formed inside the cross section of the tension member or compression member such as a pair of bump elements formed inside the cross section of the compression or tension members in such way that it prevents the edges of each planar metallic piece to laterally move.

Although in the above described preferred embodiment, the spare brake beam has a common design (tension member, compression member, etc.), it may have other design, for example a one piece brake beam in which the tension and compression member are welded together, as well as the brake head subassemblies, or brake beams lacking the tension member.

Finally it must be understood that the spare brake beam, of the present invention, is not limited exclusively to the embodiments above described and illustrated and that the persons having ordinary skill in the art can, with the teaching provided by the invention, to make modifications to the design and component distribution of the spare brake beam of the present invention, which will clearly be within of the true inventive concept and of the scope of the invention which is claimed in the following claims:

I claim:

1. A spare brake beam for linking a pair of brake head subassemblies, the spare brake beam for installation in a boogie of a railway car having pocket guides for slidably receiving end extensions of a brake beam and opposed end extensions, said spare brake beam comprising:

an elongated main body with a first end and a second end, at least one interlocking member coupled at an end of the main body, each interlocking member comprising a solid planar metal piece, a brake beam coupling section, and an end extension coupling section, the end extension coupling section being located opposite to the brake beam coupling section, the end extension coupling section including i) a coupling edge having an irregular shape, ii) a bore in a central portion thereof, and iii) a lesser width than a width of the brake beam coupling section; and at least one end extension having a pocket guide coupling member opposite an interlocking member coupling section, each interlocking member coupling section comprising a clasp formed by two quadrangular planar metallic pieces and an interlocking member coupling edge receiving section located between the two quadrangular planar metallic pieces, each quadrangular planar metallic piece including a bore in a central portion thereof, the interlocking member coupling edge receiving section having an opposed shape of the irregular shape of the coupling edge receiving section, wherein, each interlocking member is received and retained between the two quadrangular planar metallic pieces of a corresponding end extension with the coupling edge of the interlocking member engaged with the interlocking member coupling edge receiving section of the interlocking member coupling section of the corresponding end extension.

2. The spare brake beam as claimed in claim 1, wherein, the main body comprises i) a "V" shaped tension member with a first end and a second end, ii) a compression member with a first end and a second end, the first end and the second end of the tension member being coupled to the first end and the second end of the compression member, iii) a brake head subassembly linked to each of the first and second ends of the compression member, iv) a fulcrum attached to the compression member and to tension member, wherein, the compression and tension member each have a channel shaped cross section, the tension member, the compression member, and the brake head subassemblies are linked together by four pairs of bolt nut assemblies, each pair bolt nut assemblies passing respectively through a first pair and a second pair of holes located at each end of the tension member and compression member and through a bore of each brake head subassembly, thus linking the tension member, compression member and brake head subassemblies together by a first pair and a second pair of linking points.

3. The spare brake beam as claimed in claim 2, wherein, the interlocking member is located at the first end of the compression member inside the channel shaped cross section of the compression member, the channel shaped cross section of the compression member being located inside the channel shaped cross section of the tension member, the bore in the central portion of the brake beam coupling section of the interlocking member coincides with a first coinciding pair of bores of a first two pairs of linking points of the tension and the compression member, the bore in the extension coupling section of the interlocking member coincides with a second coinciding pair of bores of a second two pairs of linking points of the tension and compression member and with the bore of the brake head subassembly, and the bore in the extension coupling section of the interlocking member having a lesser width than a width of the brake beam coupling section.

4. The spare brake beam as claimed in claim 3, wherein, the brake beam coupling section of the interlocking member is coupled to the first end of the tension member and to the first end of the compression member by a bolt passing trough the first coinciding pair of bores of the linking points of the compression and tension member which also passes through the bore located at a central portion of the brake beam coupling section thus joining the coupling section, and the end extension coupling section of the interlocking member is i) coupled to the tension member, to the compression member, and to the brake head subassembly and ii) received between the two planar metallic pieces of the clasp of the end extension, in such way that the coupling edge of the end extension coupling section engages with the interlocking member coupling edge receiving section and is retained therein by a bolt passing trough the second coinciding pair of bores of the second two pairs of linking points of the compression member, the tension member and the brake head subassembly and also passing through the bore located at the central portion of the end extension coupling section of the interlocking member and through the bores located at the central portion of the two planar metallic pieces thus joining the tension member, the compression member, the brake head subassembly, the interlocking member and the end extension together.

* * * * *